US005601044A

United States Patent [19]

Hara

[11] Patent Number: 5,601,044

[45] Date of Patent: Feb. 11, 1997

[54] SAILBOAT

[75] Inventor: Ioki Hara, Iwata, Japan

[73] Assignee: Yamaha Hatsudoki Kabushiki Kaisha, Iwata, Japan

[21] Appl. No.: 511,353

[22] Filed: Aug. 4, 1995

[30] Foreign Application Priority Data

Aug. 4, 1994 [JP] Japan ..... 6-183185
Aug. 4, 1994 [JP] Japan ..... 6-183186

[51] Int. Cl.[6] ..... B63B 35/00

[52] U.S. Cl. ..... 114/39.1; 114/90; 114/103

[58] Field of Search ..... 114/90, 91, 97, 114/98, 102, 103, 39.1

[56] References Cited

U.S. PATENT DOCUMENTS 2,484,687 10/1949 Carl, Jr. ..... 114/103
3,195,494 7/1965 Robin .
3,838,655 10/1974 Kratz ..... 114/90
4,077,345 3/1978 Gurley .

FOREIGN PATENT DOCUMENTS 184782 6/1986 European Pat. Off. .
2467773 4/1981 France .

*Primary Examiner*—Jesus D. Sotelo
*Attorney, Agent, or Firm*—Knobbe, Martens, Olson & Bear LLP

[57] ABSTRACT

A sailboat having an improved mast and boom arrangement wherein the mast is pivotally supported relative to the hull about an axis that is disposed rearwardly from the mast and close to but in front of the normal center of pressure on the sail carried thereby so as to reduce the turning moments on the hull during sailing and improve the speed performance. An improved pivotal arrangement for the boom is disclosed, as is a pivotal connection between the mast and the boom which permits the mast to be easily raised and lowered.

11 Claims, 8 Drawing Sheets

SAILBOAT

BACKGROUND OF THE INVENTION

This invention relates to a sailboat and more particularly to an improved main sail construction for such boats.

As is well known with conventional sailboats, the main sail is supported by a mast and boom assembly. The mast supports the forward vertical edge of the sail while the boom supports the lower horizontal edge of the sail. The boom swings relative to an axis defined by the mast upon sailing and various angles are set by the sailors to obtain the desired motion of the sailboat.

Because of the fact that the force of the sail is transmitted to the hull through the mast, there exists a moment on the hull which can cause the hull to tend to rotate about a vertical axis defined by the mast. This situation may be best understood by reference to FIG. 1 which shows a conventional prior art type of sailboat when in a tacking condition. The sailboat, indicated generally by the reference numeral 11, has a hull 12 on which a mast 13 is supported. The mast 13 is positioned slightly forwardly of the forward edge of a keel 14 which depends from the underside of the hull into the water body. This keel 14 is disposed on a longitudinal center line 15 of the hull 12. To the rear of the hull there is mounted a pivotally supported rudder 16 for steering of the sailboat 11.

A boom 17 is pivotally supported on the mast 13 so that a sail 18 thereon may be disposed at the desired angle to the wind, blowing in the direction shown in the arrow 19 so as to effect movement of the sailboat 11 through the body of water. The sail 18 has a pressure center 21 on which the wind force acts. In the illustrated embodiment, the boom 17 is swung to an angle so as to effect tacking of the sailboat 11. This is movement in a direction generally opposite to or against the wind direction.

The wind across the sail 18 acts through a center of pressure 21 in a direction of force indicated by the arrow A in the vector diagram in this figure. This force resolves into a forward force B and a side thrust force C. Because the center of the mast 13 is offset from the pressure point 21 by a distance $L_1$, there is generated a turning moment indicated by the arrow M on the watercraft which tends to cause it to rotate and also to side slip. The side slipping action is resisted primarily by the keel 14. As is known the wind force also creates a force about a horizontal axis tending to cause the hull 12 to heal over. The action of the keel 14 also resists this healing action.

Rotation of the hull 12 about the vertical axis defined by the mast 13 is avoided by turning the rudder 16 as shown in this figure so that it generates a force indicated by the force vector E through its action with the water. This force generates a side force D which resists the turning moment M. However, it also provides a drag force F which reduces the forward speed of the hull.

The boom 17 is held against rotation by a force G exerted through a rope on the end of the boom 17 and which acts through a distance L3 from the pivot axis. This distance is greater than the distance L2 from the center of force and hence resists the rotation of the boom 17 and sail 18 so as to permit the force on the sail to achieve the forward motion of the hull 12.

Thus, by mounting the sail so that its forward edge is in line with the mast and with the boom pivoting about this same axis, a considerable drag force is exerted to keep the hull traveling in a forward direction.

It is, therefore, a principal object of this invention to provide an improved mast, sail and boom arrangement for a sailboat. It is a further object of this invention to provide an improved mast, boom and sail arrangement for a watercraft wherein the performance of the watercraft can be substantially improved.

Although it would appear obvious to move the center of the pivot point of the boom 17 to the area in line with the center of pressure, the center of pressure actually shifts as the boom is pivoted. Thus it is not possible to maintain this alignment under all conditions. Furthermore, a situation may arise where the center of pressure can move forwardly of the pivot axis on tacking and this will cause erratic and unsmooth running.

It is, therefore, a still further object of this invention to provide an improved boom, mast and sail arrangement for a watercraft.

One solution to the aforenoted problem is the mounting of the boom for pivotal movement about an axis that is defined apart from the mast. In this way, the pivot axis of the boom need not be coincident with the axis of the mast. However, this gives rise to problems in the design of the hull and also in the design of the pivotal support for the boom.

It is, therefore, a further object of this invention to provide an improved pivotal support for the boom of a sailboat.

It is another object of this invention to provide an improved boom pivotal support which can be well grounded in the hull, but which does not require coincidence with nor utilization of the mast for this pivotal support.

Another problem with sailboats is that the mast is generally mounted in the hull in a relatively permanent fashion. Although it is possible to step the mast, storage then becomes a problem and the actual detachment of the mast from the hull is not a convenient maneuver.

It is, therefore, a still further object of this invention to provide an improved mast and boom arrangement for a sailboat.

It is a yet further object of this invention to provide a mast arrangement for a watercraft wherein the mast is pivotal relative to the boom and can be pivoted into a horizontal position adjacent the boom rather than vice versa.

SUMMARY OF THE INVENTION

A first feature of this invention is adapted to be embodied in a sailboat and mast arrangement. The sailboat has a hull having a boom that is supported for pivotal movement about a generally vertical axis which is disposed between the ends of the boom. A mast is provided at one end of the boom and is adapted to support a vertical portion of a sail with the horizontal portion being attached to the boom.

In accordance with another feature of the invention, the pivotal support for the boom is provided by a fixed axle that extends from the lower portion of the hull adjacent a keel to the deck. The boom carries upper and lower bearings for pivotal support on this axle.

In accordance with another feature of the invention, the mast is connected to the boom by a pivot arrangement for pivoting of the mast into a position extending horizontally and adjacent the boom.

DETAILED DESCRIPTION OF THE PREFERRED EMBODIMENTS OF THE INVENTION

Figure 1:
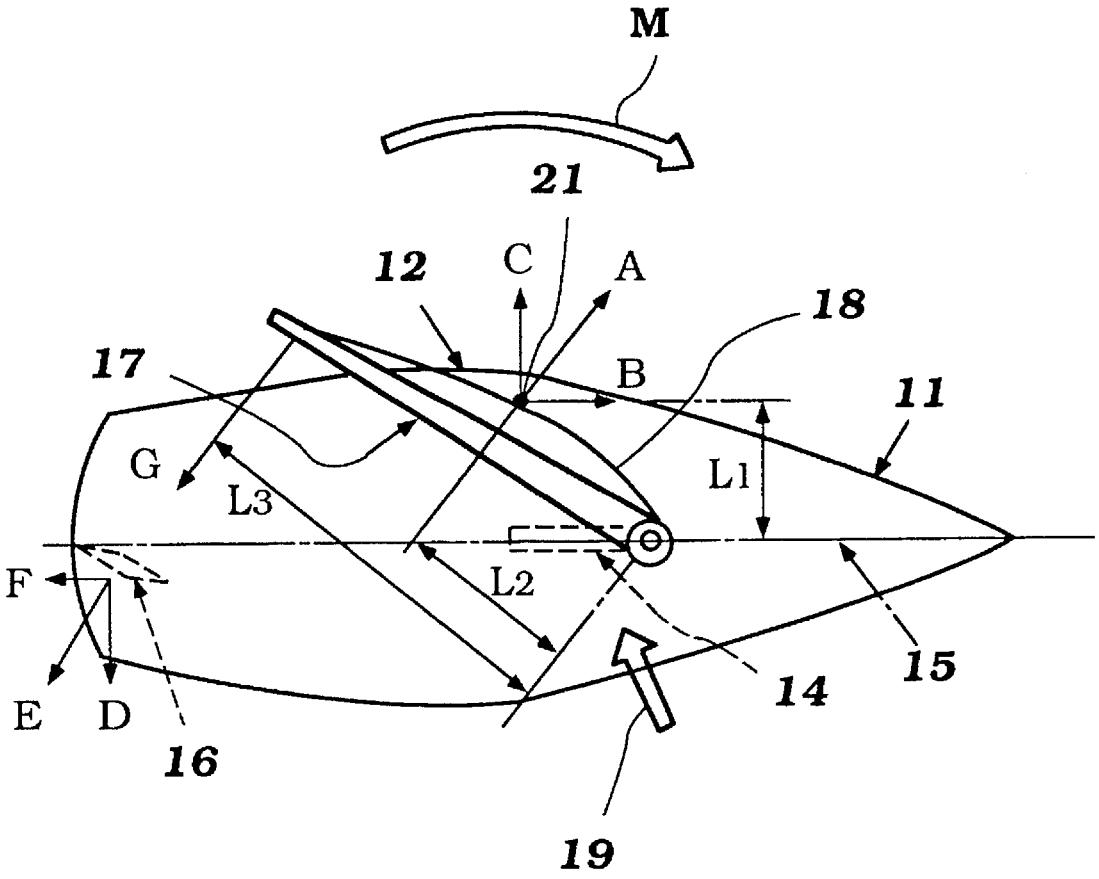
Figure 1 Prior Art
FIG. 1 is a top plan vector diagram of a prior art type of sailing vessel showing the forces when in a tacking condition.
Figure 2:
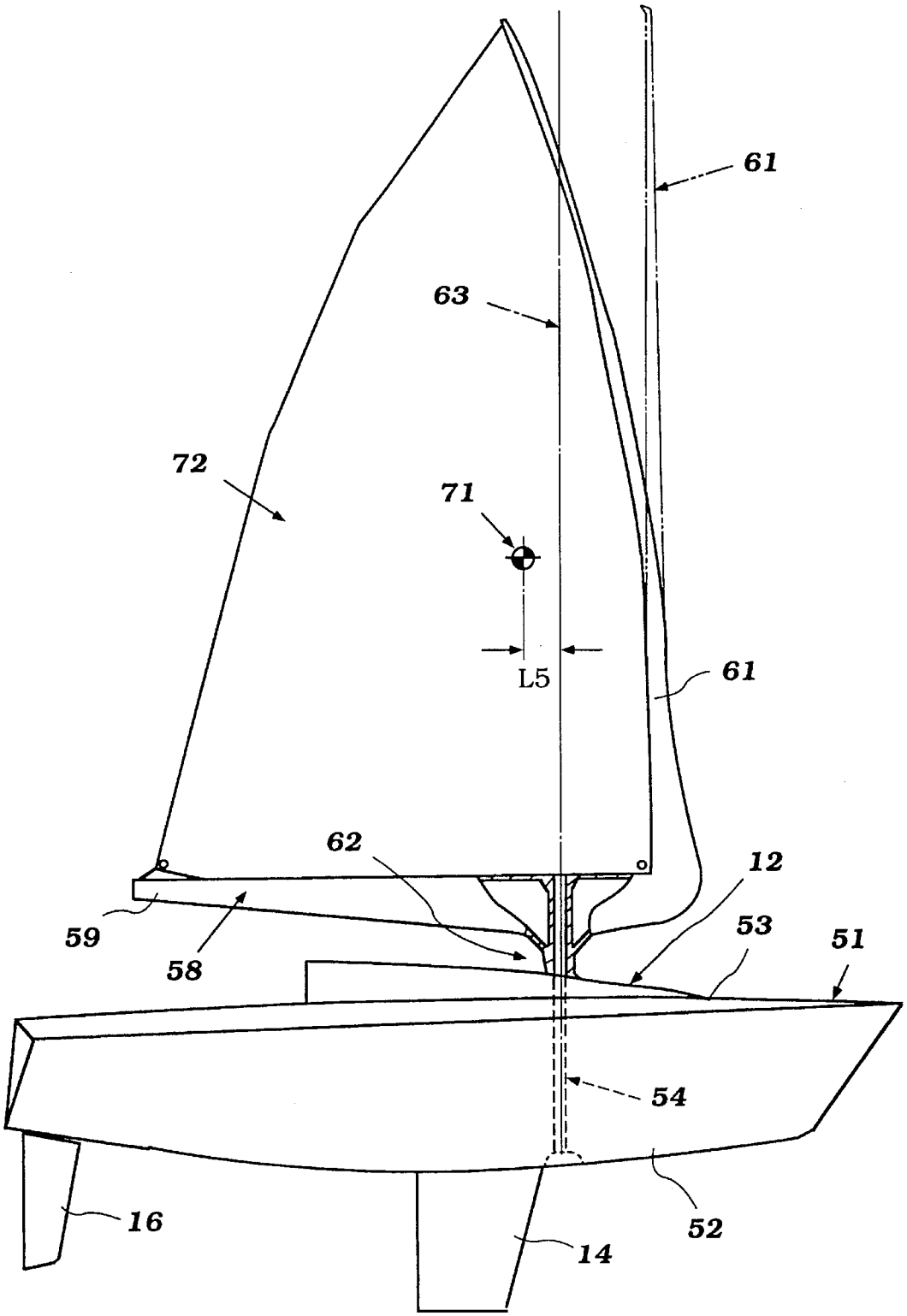
FIG. 2 is a side elevational view of a sailboat constructed in accordance with a first embodiment of the invention.
Figure 3:
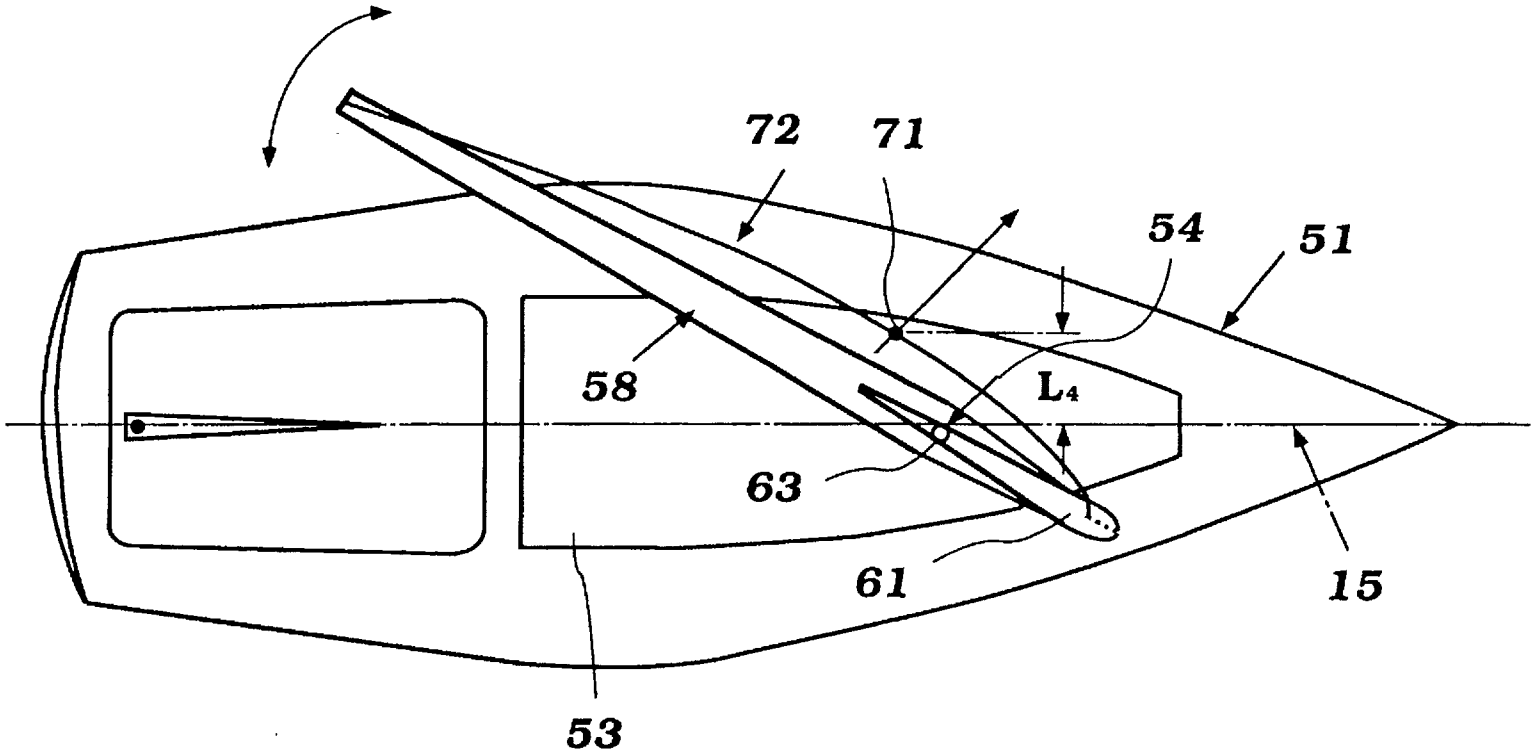
FIG. 3 is a top plan view of the sailboat showing the forces which act during tacking.
Figure 4:
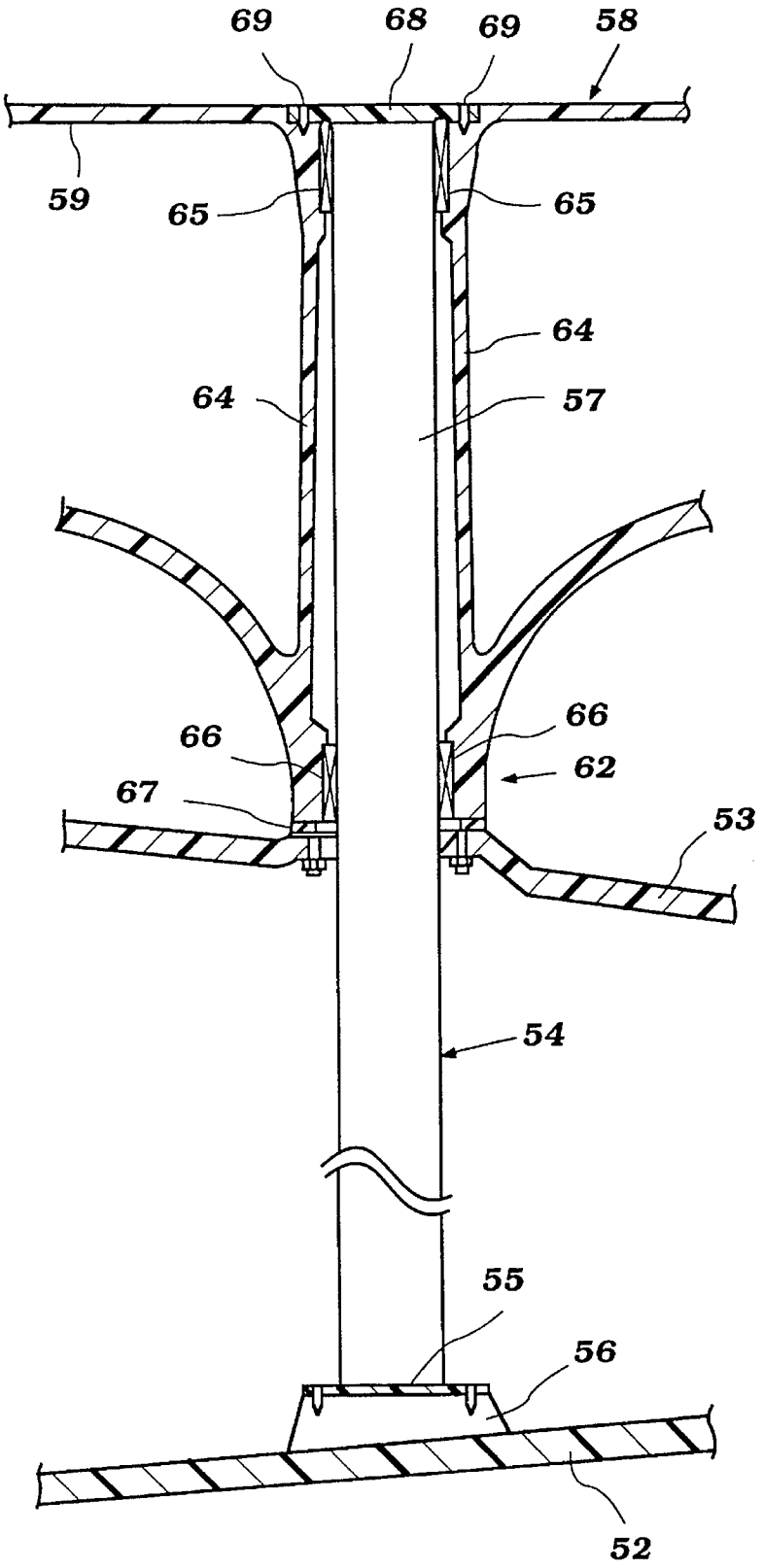
FIG. 4 is an enlarged cross-sectional view showing the pivotal support for the boom.

Referring now in detail to the drawings and initially to the embodiment of FIGS. 2–4, a sailboat constructed in accordance with this embodiment of the invention is identified generally by the reference numeral 51. The basic construction of the sailboat 51 is similar to that of the prior art and hence where the components are the same or substantially the same, they have been identified by the same reference numerals as applied in that figure. However, FIG. 2 shows a side elevation and FIG. 4 shows an enlarged cross-section which emphasize the distinctive features of the invention.

The hull 12 is in the illustrated embodiment, comprised of a lower portion 52 and an upper deck 53 that is affixed to the hull 52 in a known manner and which defines a rider's area to the rear thereof. The deck 53 and hull 52 may also form a small cutty cabin at the front. In accordance with a feature of the invention, an axle, indicated generally by the reference numeral 54 and shown in most detail in FIG. 4, is provided with a base 55 that is affixed to an anchor 56 which is, in turn, affixed to the upper side of the lower hull surface 52. The axle 54 has a portion 57 which extends above the upper portion of the deck 53. The axle supports a mast, boom and sail in a manner which will be described.

A boom, indicated generally by the reference numeral 58, has a horizontally extending portion 59 with a mast 61 extending upwardly at the forward end thereof. The boom horizontal portion 59 is provided with a hub assembly, indicated generally by the reference numeral 62, and which has a construction as best shown in FIG. 4 by which it is journaled for rotation about a vertically extending axis 63 defined by the axle 54.

This hub portion 62 is comprised of a cylindrical part 64 which may be formed integrally with the lower surface of the horizontal part 59 and which carries an upper bearing 65 and a lower bearing 66, each of which provides a journal with the axle 54. A lower thrust bearing 67 is provided between the lower end of the hub portion 62 and the surface of the deck 53 to fix one axial location of the boom 58 on the axle 54. The other end is located by a closure plate 68 that is affixed to the boom horizontal portion 59 by fasteners 69. It should be noted that the axis 63 is such that it is off set by a relatively small amount L5 from the normal pressure center 71 formed by a sail 72.

The sail 72 is affixed with its lower edge to the boom horizontal portion 59 and its upper vertical edge to the mast portion 61. The sail 72 may be placed under some tension so that the mast portion 61 can deflect from the normal unloaded phantom line configuration shown in FIG. 2 to the normal operating condition as shown in the solid line portion of this figure.

Because of the more aft pivotal axis 63 along the boom, the forward thrust force vector will be disposed a smaller distance L4 from the boat center line 15 than with the prior art type of construction. However, the construction is such that during normal positioning of the boom 58 the pressure point 71 will always be behind the axis 63 so that smooth sailing operation will result.

In the embodiment as thus far described, the mast 61 and boom horizontal portion 58 have been formed as a unitary assembly. Next will be described an embodiment wherein the assembly is provided with a pivotal connection between the boom 58 and the mast 61 and, except for that difference and the mechanism for erecting the mast, the structure is the same as that already described and, for this reason, components which are the same have been identified by the same reference numerals and will not be described again except insofar as is necessary to understand the construction and operation of this embodiment.

Figure 5:
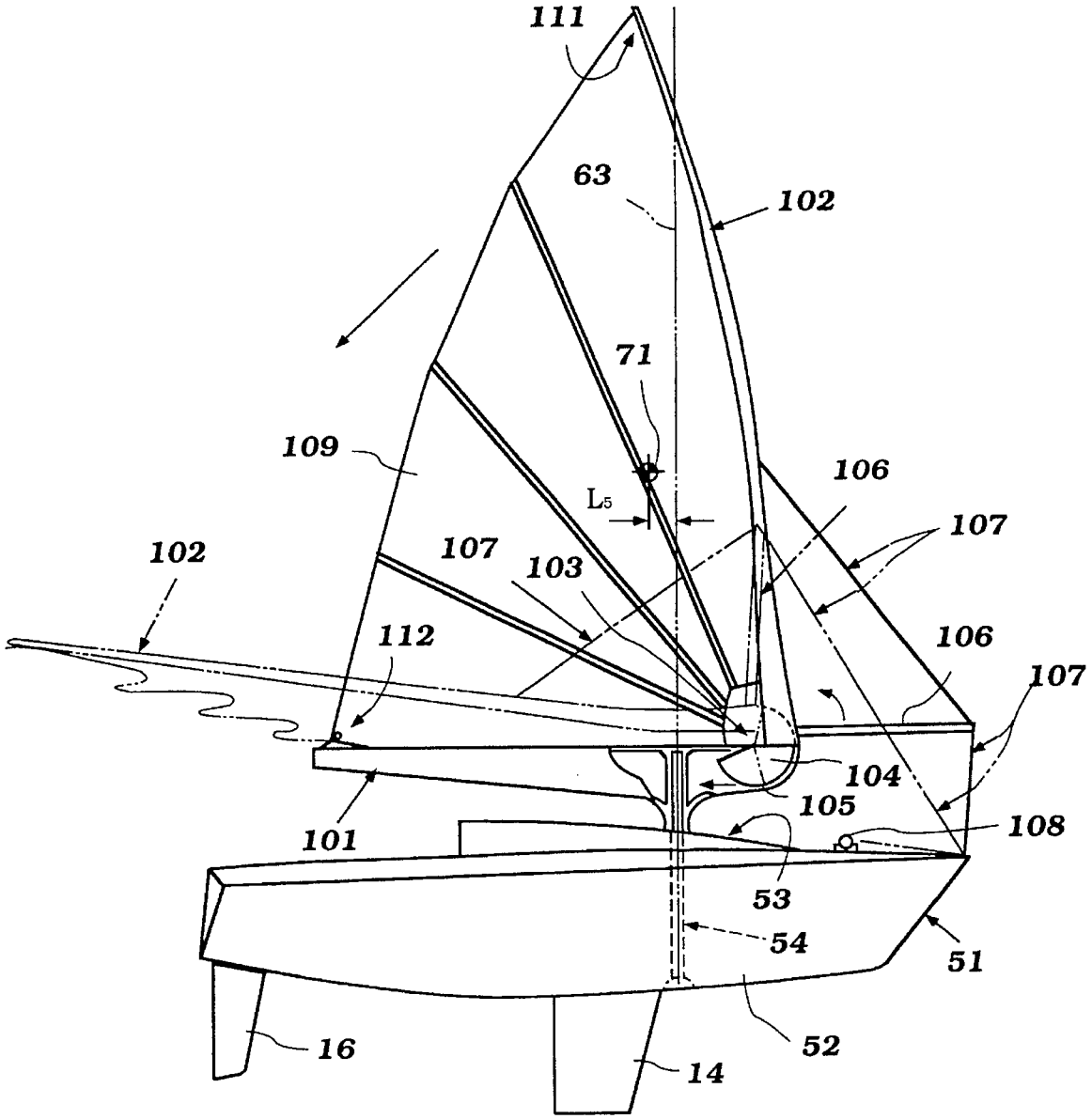
FIG. 5 is an enlarged side elevational view showing another embodiment of the invention with the mast in its erected position in solid lines and in its retracted position in phantom lines.
Figure 6:
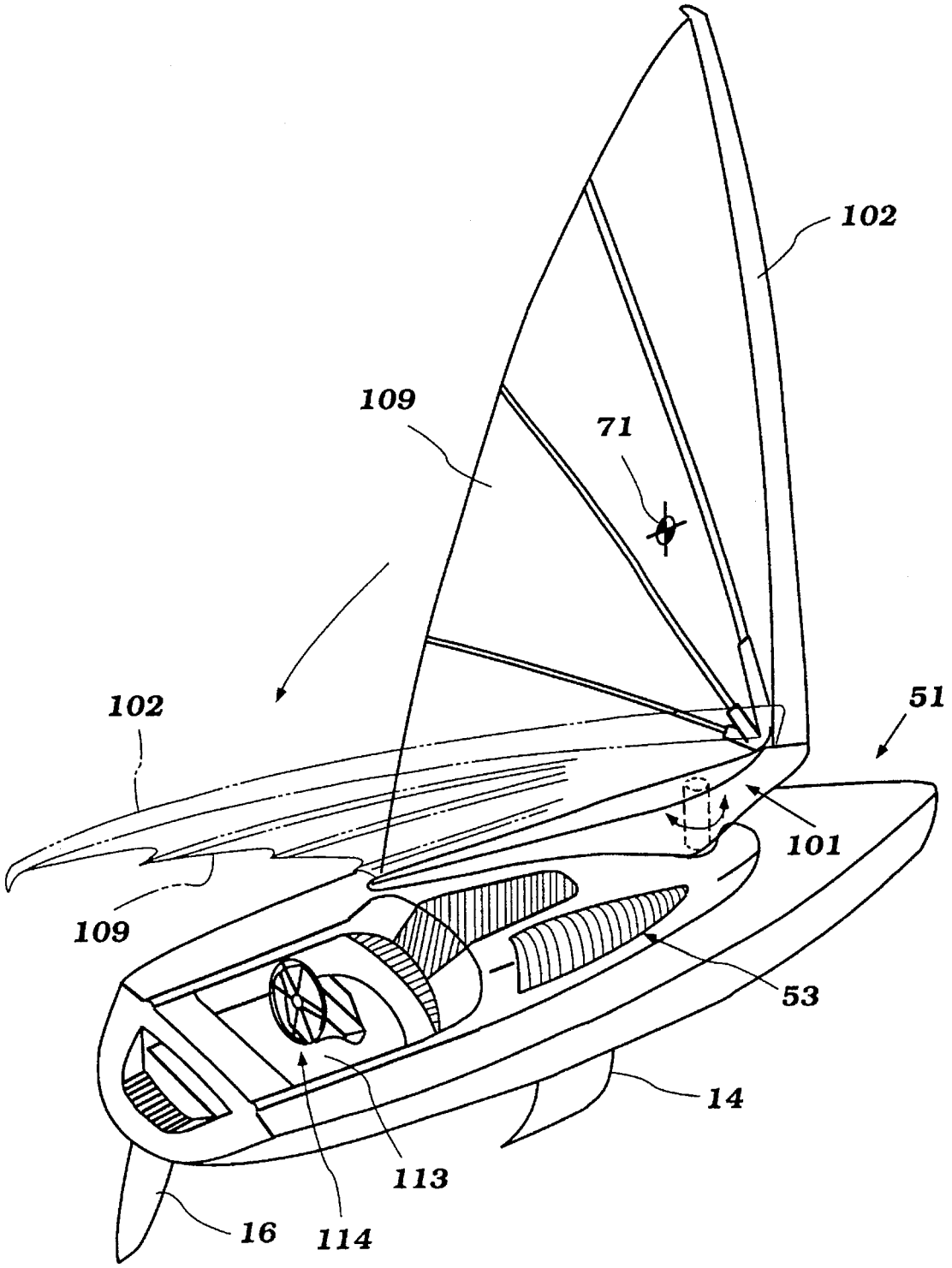
FIG. 6 is a perspective view of this embodiment and taken generally from the rear portion and one side thereof.

The embodiment is shown in FIGS. 5 and 6 and the boom assembly is indicated in this embodiment by the reference numeral 101 with the mast being indicated generally by the reference numeral 102. A pivotal connection, indicated generally by the reference numeral 103, is provided between the lower end of the mast 102 and the forward end of the boom 101. This pivotal connection will be described in more detail later by reference to FIGS. 8 and 9 of the final illustrated embodiment.

However, it includes basically a disk-shaped bearing element 104 that is contained within a journaling portion 105 formed at the forward end of the boom 101. In order to erect the mast, a rigid bar 106 is affixed to the lower end of the mast 102. The rigid bar 106 can be connected by means of guide wires 107 to a winch 108 so as to be raised and lowered between the positions shown in solid and phantom lines in FIGS. 5 and 6. The sail, indicated by the reference numeral 109, may be connected by fasteners 111 to the upper end of the mast 102 and by fasteners 112 to the rear end of the boom 101. Additional fasteners may be employed obviously for this connection.

FIG. 6 shows the ship in more detail, and in this figure the passenger's compartment may be seen and it is identified by the reference numeral 113 and contains a helm 114 for steering the rudder 16 in a well-known manner. The cutty cabin also appears in more detail in this figure.

Figure 7:
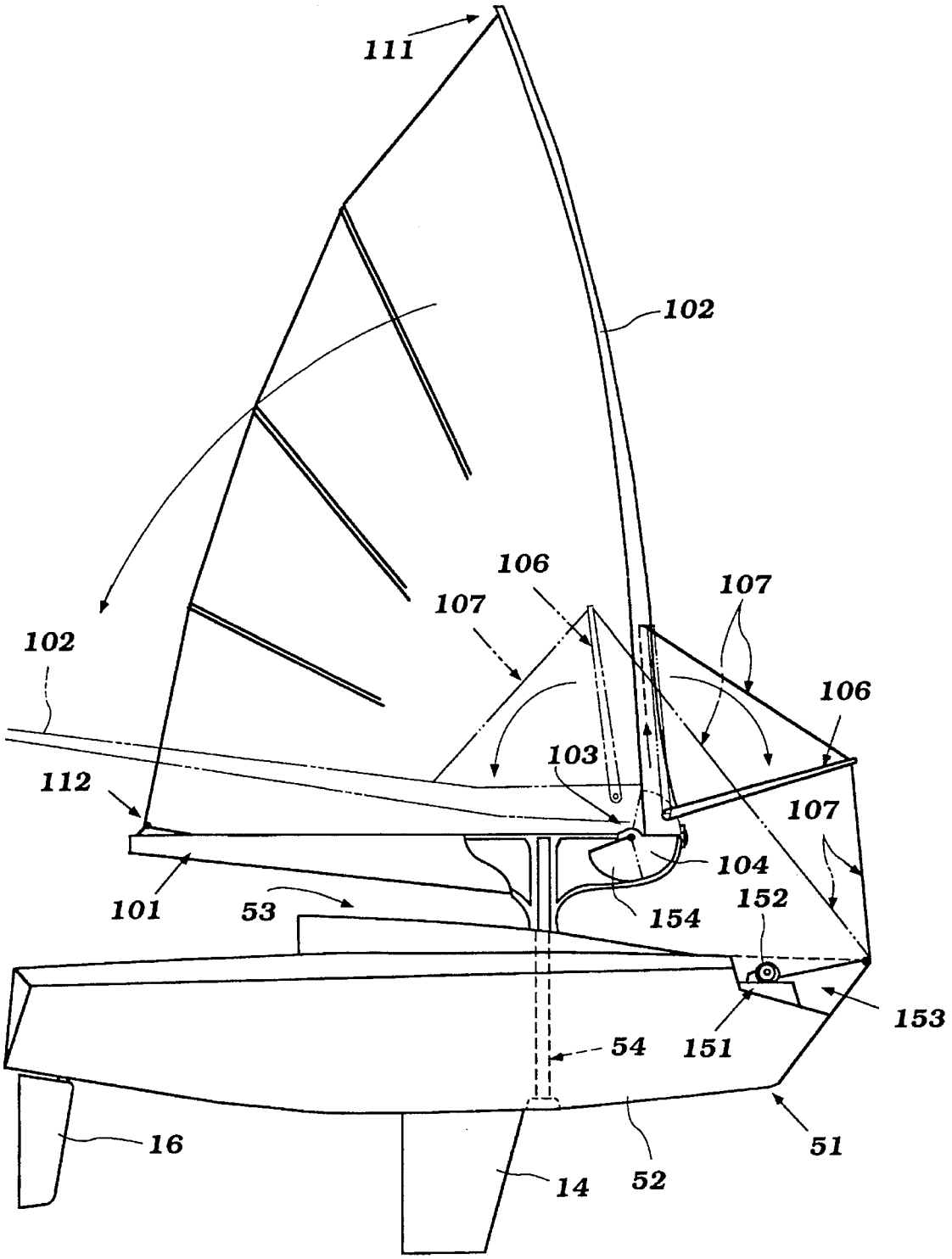
FIG. 7 is a side elevational view, in part similar to FIG. 5, and shows another embodiment of the invention.
Figure 8:
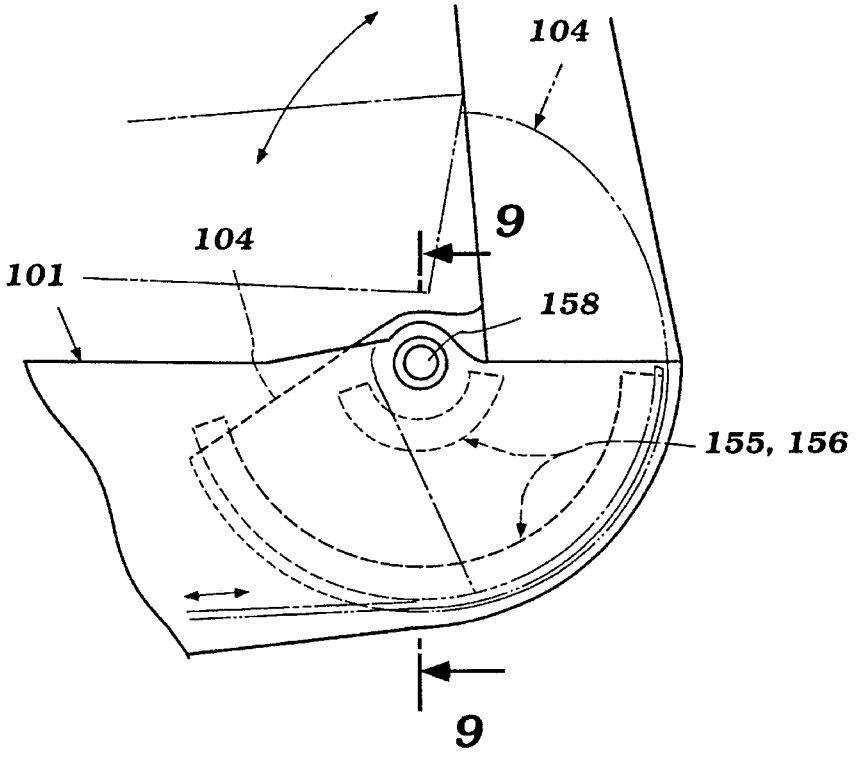
FIG. 8 is a side elevational view showing the pivot connection between the boom and mast.
Figure 9:
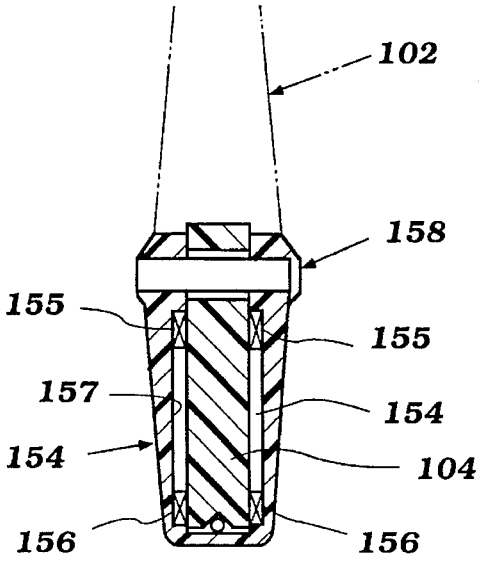
FIG. 9 is a cross-sectional view taken along the line 9—9 of FIG. 8.

The construction by which the mast 102 is raised and lowered may be best understood by reference to FIGS. 7–8, and this shows another embodiment wherein a winch 151, rather than being mounted on a forward portion of the deck 152 as in the embodiment of FIG. 5, is actually concealed beneath this deck portion 152 in a recess 153 formed at the forward end of the hull.

As may be seen in most detail in these figures, the forward portion of the boom 101 defines an internal pocket 154 in which the segment 104 is rotatably journaled between a pair of radially inwardly disposed bearings 155 and a pair of radially outwardly disposed bearings 156. These bearings 155 and 156 are mounted between spaced side walls 157 which define the pocket 154. The pivotal axis for the mast 102 is shown in these figures and identified by the reference numeral 158. Hence, the mast 102 may be easily pivoted between its lowered and raised positions because of this bearing support.

It should be readily apparent from the foregoing description that the described sailboat construction provides smoother sailing and faster speed because of the offset pivotal axis for the boom. In addition, the journal for the boom is very robust and permits good motion with minimum obstruction to the watercraft. The pivotal connection between the mast and the boom also permits stepping of the mast without large effort and permits the mast to be raised again very quickly when desired. Of course, the foregoing description is that of preferred embodiments of the invention, and various changes and modifications may be made without departing from the spirit and scope of the invention, as defined by the appended claims.

I claim:

1. A sailboat and mast arrangement, said sailboat having a hull, a boom supported for pivotal movement about a generally vertical axis disposed between the ends of said boom, a mast at one end of said boom and adapted with said boom to support a sail having a leading edge affixed to said mast and a trailing edge affixed to said boom, the center of pressure of the wind forces acting on said sail in normal positions being disposed to the rear of the vertical axis about which the boom pivots and spaced a substantially lesser distance from said pivot axis than the from of said boom, and a keel depending from said hull and disposed so that its forward end terminates adjacent said pivot axis of said boom.

2. A sailboat and mast arrangement as in claim 1, wherein the pivotal connection between the mast and the boom extends about an axis that is transverse to the boom and the mast and the mast has a cylindrical segment that is received between a pair of radially spaced bearings carried by the boom for controlling the pivotal movement of the mast relative to the boom.

3. A sailboat and mast arrangement as in claim 1, wherein the pivot axis for the boom is defined by a pair of spaced-apart bearings fixed relative to the upper and lower edges of the boom.

4. A sailboat and mast arrangement as in claim 3, wherein the bearings are formed internally of the boom.

5. A sailboat and mast arrangement as in claim 3, wherein the bearings are supported on an axle that extends through the upper deck of the hull and is anchored at its lower end to the lower portion of the hull contiguous to the keel.

6. A sailboat and mast arrangement as in claim 5, wherein the mast is pivotally connected to the boom at the lower end of the mast and at the forward end of the boom.

7. A sailboat and mast arrangement as in claim 6, wherein the pivotal connection between the mast and the boom extends about an axis that is transverse to the boom and the mast and the mast has a cylindrical segment that is received between a pair of radially spaced bearings carried by the boom for controlling the pivotal movement of the mast relative to the boom.

8. A sailboat and mast arrangement, said sailboat having a hull and a boom, bearings contained internally within said boom for supporting said boom for pivotal movement about a generally vertical axis by said hull, a mast connected to one end of said boom and adapted to cooperate with said boom for supporting a sail.

9. A sailboat and mast arrangement as in claim 8, wherein the hull further has a keel.

10. A sailboat and mast arrangement as in claim 9, wherein the bearings are supported on an axle that extends through the upper deck of the hull and is anchored at its lower end to the lower portion of the hull contiguous to the keel.

11. A sailboat and mast and boom arrangement, said sailboat having a hull, a boom supported for pivotal movement about a generally vertically extending axis by said hull, a mast having a pivotal connection at its lower end to the forward end of said boom for movement of said mast between a vertically extending position and a horizontally extending position adjacent said boom, said pivotal connection extending about an axis that is transverse to said boom and said mast, said mast having a cylindrical segment that is received between a pair of radially spaced bearings carried by said boom for controlling the pivotal movement of said mast relative to said boom.

* * * * *